US005777248A

United States Patent [19]

Campbell

[11] Patent Number: 5,777,248

[45] Date of Patent: Jul. 7, 1998

[54] TUNING INDICATOR FOR MUSICAL INSTRUMENTS

[76] Inventor: James A. Campbell, 7136 Plymouth Rd., Ann Arbor, Mich. 48105

[21] Appl. No.: 684,631

[22] Filed: Jul. 22, 1996

[51] Int. Cl.[6] ..... G10G 7/02

[52] U.S. Cl. ..... 84/454; 84/477 R; 84/DIG. 18

[58] Field of Search ..... 84/454, 477 R, 84/DIG. 18

[56] References Cited

U.S. PATENT DOCUMENTS

| | | | |
|---|---|---|---|
| 3,861,266 | 1/1975 | Whitaker | 84/454 |
| 3,901,120 | 8/1975 | Youngquist | 84/454 |
| 4,014,242 | 3/1977 | Sanderson | 84/454 |
| 4,078,469 | 3/1978 | Calvin | 84/454 |
| 4,196,652 | 4/1980 | Raskin | 84/458 |
| 4,331,060 | 5/1982 | Allen | 84/454 |
| 4,457,203 | 7/1984 | Schoenberg et al. | 84/454 |
| 4,796,509 | 1/1989 | Mizuguchi | 84/454 |
| 5,056,398 | 10/1991 | Adamson | 84/454 |
| 5,549,028 | 8/1996 | Steinberger | 84/454 |

*Primary Examiner*—Michael L. Gellner
*Assistant Examiner*—Shih-yung Hsieh

[57] ABSTRACT

A musical instrument tuning aid. The display provides the user tuning information in a rapidly interpreted form. The input note, or tuning device setting, is displayed in a clock face format. A sharp/flat indicator provides a course display for gross tuning. A display means for electronically producing a stroboscopic display between the input tone and the internally generated reference frequency provides for very accurate fine tuning with instantaneous response to pitch changes. Signal conditioning to control signal level enhances the strobe display. Tracking low pass filtering is provided to enhance strobe display for high harmonic content signals. An adjustable band pass filtering mode is provided to allow analysis of individual harmonics. A crystal timebase is used to generate a high accuracy reference frequency with fine calibration adjustment. A control means is provided to measure the input signal fundamental, select the nearest chromatic scale note, and set tuning device accordingly, allowing hands off operation. In automatic mode the note display tracks the input note providing an easy to read display indicating the note played, as well as tuning of that note.

13 Claims, 3 Drawing Sheets

TUNING INDICATOR FOR MUSICAL INSTRUMENTS

TECHNICAL FIELD

This invention is related to tuning devices and displays for the analysis of musical tones. The tuning device provides a display of information about pitch and its variation from a reference frequency corresponding to a note in the chromatic scale. The invention is used for musical instrument tuning and adjustment. It is also useful for musical training.

BACKGROUND

Numerous methods and devices are available to aid the musician in the tuning of musical instruments. These devices are also used for the tuning and adjustment of musical instruments by technicians. The simplest of these are devices which produce accurate tones for reference in tuning by ear. These include tuning forks, pitch pipes, and electronic tone generation devices.

There are also many tuning devices with visual indications to show error from a reference pitch. The user selects the note to be tuned (reference pitch) and the instrument indicates the magnitude and direction of error between the reference pitch and the input signal.

The strobe tuner is the preferred tuning instrument used by technicians. The strobe tuner has two basic components. The first is a rotating disk with a pattern of concentric rings. The rings consist of bars organized such that each ring has twice as many bars as the pervious ring as you move outward on the disk. This disk is rotated by a motor whose speed is controlled at the reference frequency. The second component is a neon bulb driven by the amplified input signal. In operation, the user selects the reference frequency for disk rotation and applies the input signal. The neon bulb is made to strobe the rotating disk bar pattern at the input signal frequency. If the reference frequency and input signal frequency are the same, the bar pattern on the disk for the corresponding octave will appear to stand still. As the input signal pitch is increased (made sharper) the bar pattern will appear to rotate to the right, and if it is lowered (made flat) the bar pattern will appear to rotate left. The user adjusts the pitch until the bar pattern rotation is stopped. These instruments are the preferred type used by technicians for piano tuning and other instrument adjustments, such as the intonation of a guitar by adjustment of the tailpiece. Their instant response to pitch change is particularly helpful for piano tuning, where the tuning pins are very sensitive and must be set properly to the correct pitch. Strobe tuners are preferred because of their accuracy and instant response to changes in pitch. However, they tend to be large, expensive, and contain moving parts prone to wear. They also must be manually set to the desired note (reference frequency). Also, harmonics of the input note produce stationary spot patterns giving false "in tune" indications at notes other than the desired note.

There are many inexpensive electronic tuners also on the market. The electronic tuner provides a method of selection of the reference pitch and a display to indicate the magnitude and direction of error. The error indication is either a meter with a needle indicator, or a pattern of LEDs showing error magnitude using several LEDs or changing flash speed. There are many methods used by these devices to determine the pitch error. The simplest devices filter and amplify the signal and use a comparator circuit to determine the input signal wave form zero crossing point. A timer is used to measure the period, which is then compared with the reference frequency period, and an error indication produced.

This technique is prone to errors when the input signal has high harmonic content due to the variations in the zero crossing times. Methods of filtering and delays have been used to reduce these effects. More complex electronic tuners digitize the input signal and use mathematical algorithms to extract the fundamental frequency for comparison to the reference. Tuners using this technique have a perceptible time delay between input pitch changes and indication changes. This delay creates difficulty in making very sensitive adjustments. Some electronic tuners contain note identification features which automatically set the reference frequency to the closest note to the input signal and indicate which note is being played. This improves the ease of use by eliminating the need to set the desired note and provides hands free operation. Those devices using a meter indicator are graduated in 5 cent (100th of semi-tone) intervals and are resolvable (repeatable) to no better than 1 cent.

A purely electronic means of generating the above described strobe effect has been used. A pattern of light generating elements, such as LEDs, can be arranged in either a bar or circular array, and a clock signal generated such that one LED at a time is enabled in repeating sequence over the period of the reference frequency. The input signal is converted to a logic level corresponding to positive and negative signal levels and used to gate the clock signal to produce a strobe pattern of LEDs which freeze with half the LEDs illuminated. When the input signal is sharp or flat the strobe pattern appears to move in one direction or the other. The disadvantage of this method is that the clipping of the input signal to generate the LED enable signal creates display noise if the input pitch is not pure. Any harmonics cause the strobe pattern to become less clear at the zero crossing points, leading to a difficult to interpret display. Various signal conditioning methods have been used to improve the display. Another disadvantage is that when the input pitch error is great, the user cannot determine if the input pitch is sharp or flat, because the display rotation is too rapid to interpret.

OBJECT AND SUMMARY OF INVENTION

The object of this invention is a device for sound signal analysis to conveniently display the pitch, and error from a standard temperament, of an input musical tone. The device is used for the tuning and adjustment of musical instruments and finds utility in the phase characterization of sound systems. The note to be tuned is selected and displayed on a light pattern arranged in two circles. The outside circle consists of 12 elements, each of which correspond to a note in the chromatic scale. "A" is at the 12 o'clock position, progressing clockwise with "C" at the 3 o'clock position, and "G#" at the 11 o'clock position. A semicircle of elements forms an inside circular pattern going from the 12 o'clock position to the 7 o'clock position. These LEDs indicate an octave, from 0 to 7. These two display arrays are thus configured in a clock face format. The input note, or device setting, can be easily read at a glance, and is interpreted with the speed of telling the time.

A larger ring of LEDs forms the strobe display array. An internal reference frequency is generated corresponding to a note in a tempered scale to be tuned. A strobe pattern between the internally generated reference frequency, and the input tone, is displayed around this ring. When in tune, a balanced strobe display appears with two groups of illuminated elements opposite each other around the display. The input signal error from the reference pitch appears as a rotation to the left if flat, or right if sharp. In addition, information about the harmonic content of the input tone is displayed. Tone quality information is provided in the form of the level of crispness of the display. Low pass filtering improves the display readability for input signals with high harmonic content. The filter corner frequency tracks the reference frequency to reduce harmonic content. The filter can also be configured as a narrow band pass filter, and adjusted relative to the reference frequency to allow the measurement of individual harmonics.

Circuitry is provided to measure the input signal fundamental and control a sharp/flat indicator. This circuitry also enables an automatic mode, where the note display follows the input signal pitch, simplifying operation.

The clock face format note and octave indicators provide an analyzer display which is easily interpreted, even from a distance, where the labels may not be visible. The strobe display array has very fine resolution and instantaneous response to pitch changes. The sharp/flat indicator provides for gross tuning to within range of the strobe display. The device can be packaged in a hand held format and has no moving parts, improving long term reliability.

REFERENCE NUMERALS IN DRAWINGS

| | | | |
|---|---|---|---|
| 12 | Strobe Display Array | 14 | Note Display Array |
| 16 | Octave Display Array | 18 | Sharp/Flat Indicator |
| 20 | Alpha-Numeric Display | 22 | Calibration Adjust Input |
| 24 | Note Select Input | 26 | Mode Select Input |
| 28 | Microphone | 30 | Micro-controller |
| 40 | Pre-amp | 42 | ALC Amplifier |
| 44 | Programmable Filter | 46 | Positive Rectifier |
| 48 | Lamp Driver | 50 | Level Controller |
| 52 | Fundamental period detector | 54 | Strobe Display Decoder |
| 56 | Phase Counter Generator | 57 | Binary Count Sequence |
| 58 | Reference Tone Generator | 60 | Speaker |
| 62 | Output Jack | 64 | Note Decoder/Driver |
| 66 | Octave Decoder/Driver | | |

DESCRIPTION OF THE PREFERRED EMBODIMENTS

Display panel format

Figure 1:
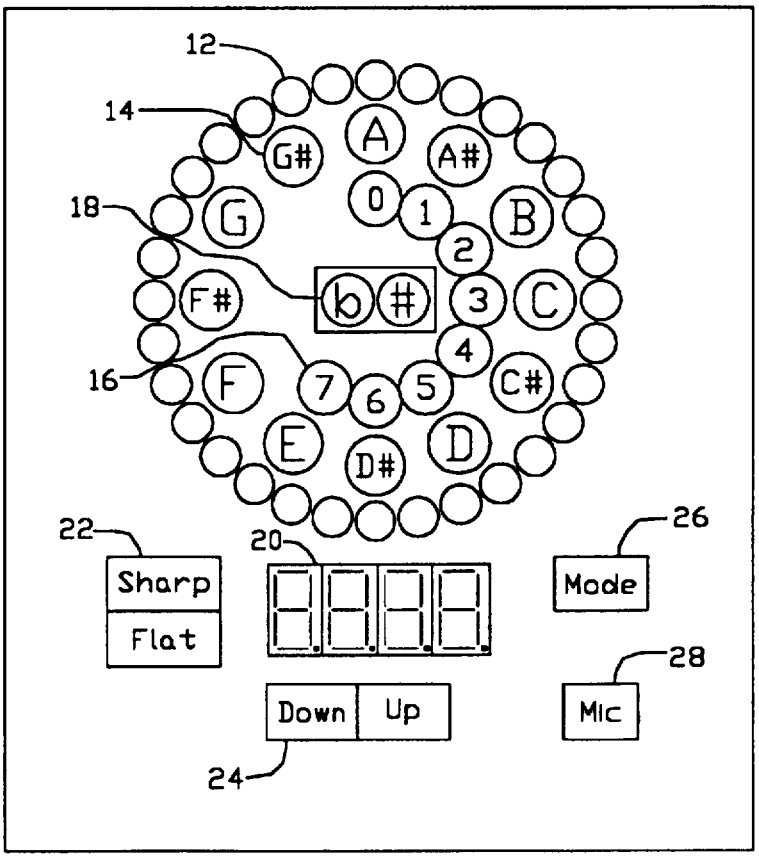
FIG. 1 shows the tuning device display and user interface.

FIG. 1 shows the display panel and user interfaces of the tuning device. The display consists of a note display array 14, an octave display array 16, a strobe display array 12, an alpha-numeric display 20 and a sharp/flat indicator 18. The user inputs consist of a calibration adjust input 22, a note select input 24, and a mode select input 26. Input is provided by a microphone 28, or an external phone jack (not shown).

The input pitch, or note selection, is displayed using the note display array 14 and the octave display array 16. These display arrays are organized in two concentric circles resembling a clock face. The note display array 14 is arranged around the outside circle and consists of 12 luminous elements, such as LEDs. These elements are labeled with the names of the notes of the chromatic scale. "A" is at the 12 o'clock position with the labels increasing chromatically in the clockwise direction. The octave display array 16 consists of eight luminous elements, such as LEDs, arranged around the inside circle, labeled with octave designations. The lowest designator is labeled "0" and the labels increase in a clockwise direction. These designators are located in the 12 o'clock to the 7 o'clock positions. By turning on a single element in each of the note display array 14 and the octave display array 16, any note, in any octave of the chromatic range, can be designated. The resemblance of this to a clock face provides an easily interpreted display. For example, the lowest octave of "A", or 0A, would correspond to 12:00 while the fourth octave of "E", or 4E, would correspond to 4:35. Once the user is familiar with the note/time correspondence, the display setting can be read with the ease and speed of telling time. It can be read at a distance, where the indicator labeling is not visible, by anyone familiar with the tuning device and reading a traditional clock face.

The strobe display array 12 consists of a plurality of luminous elements, such as LEDs, arranged in a circular pattern. A stroboscopic pattern between the internally generated clock signal corresponding to the selected note of a tempered scale, and the input pitch, is displayed on this array. The result is that when the two pitches are exactly matched, two groups of illuminated segments appear opposite each other around the circle and appear to stand still. If the input pitch is sharper than the reference pitch, the illuminated spots will appear to rotate to the right. If the input pitch is flat compared to the reference pitch, these groups will appear to rotate to the left. Much additional information is also presented the to the user concerning phase, harmonic content, and tone quality.

The sharp/flat indicator 18 is used to display course sharp/flat measurements. This is useful for initial tuning when the error may generate a very rapid rotation of the strobe display array 12. The sharp/flat indicator 18 can be a meter with the needle deflecting right/left to indicate sharp/flat. Or it can be several luminous elements indicating magnitude and direction of pitch error.

The alpha-numeric display 20 is used to indicate mode settings and tuning device calibration. The calibration can be displayed in cent deviation, sharp or flat, from a standard pitch. Or, it can display the calibration in terms of the frequency 4A; such as 440 Hz or 435 Hz.

The user can control the tuning device operation through several user inputs. The note select input 24 is used to manually set the internal reference frequency of the tuning device. The calibration adjust input 22 is used to adjust the tuning device calibration. The mode select input 26 is used to set the various operating modes of the tuning device.

Figure 2:
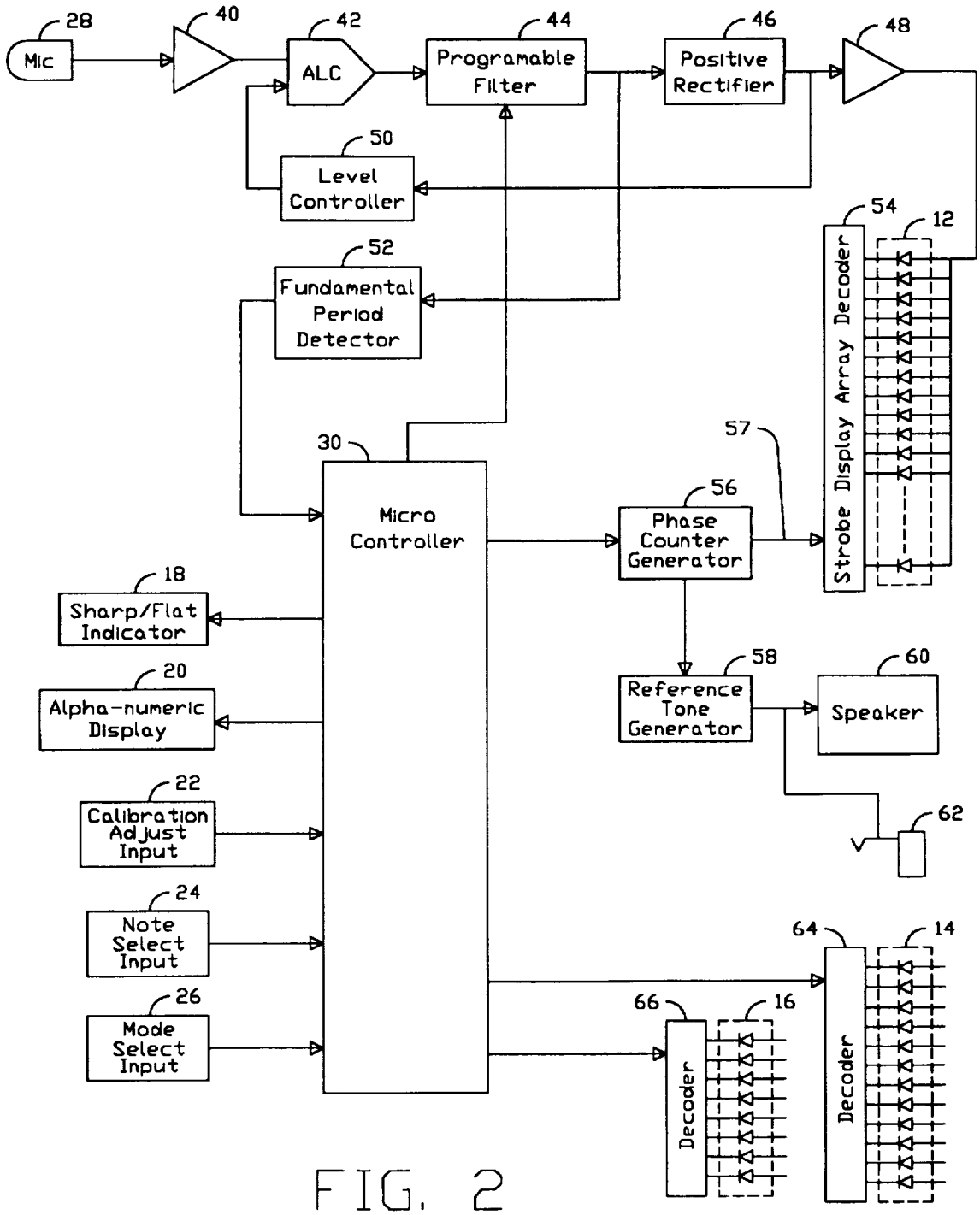
FIG. 2 shows one preferred embodiment.
Figure 3A:
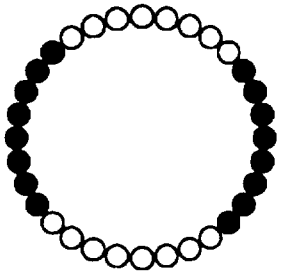
FIG. 3 shows the strobe display for various inputs.
Figure 3B:
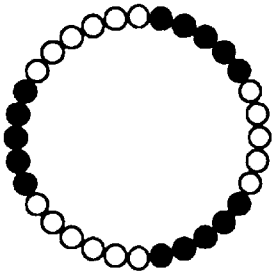
Figure 3C:
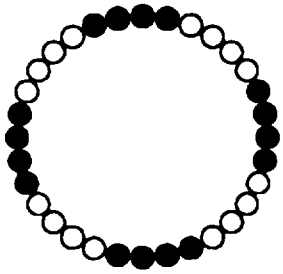
Figure 3D:
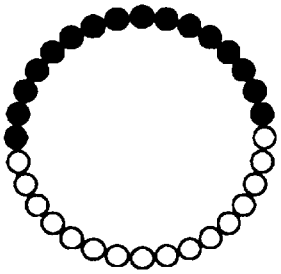

Circuit Composition (FIG. 2)

FIG. 2 shows the block diagram of the tuning device, illustrating all of the functional blocks to control the display and user interface.

A micro-controller 30 controls the operation of the tuning device. The fine tuning display is the strobe display array 12. This array is controlled by a strobe display decoder 54. A phase counter generator 56 produces a binary count sequence 57, which is applied to the strobe display decoder 54. The result is that one element of the strobe display array 12 is enabled at a time, in a sequence around the array, in a clockwise direction. The number of LEDs in the strobe display array 12, is determined by the number of bits in the binary count sequence 57. For example, a 5 bit wide binary count sequence 57 would control a strobe display array 12 consisting of 32 elements. In general, the more LEDs used in the strobe display array 12, the higher the detail of the display.

The rate of the count sequence produced by the phase counter generator 56 is controlled by the micro-controller 30. The reference frequency, F, is the frequency of the note to be tuned. The rate of the binary count sequence 57 is adjusted so that it repeats itself at a frequency of F/2. Thus the strobe display array is cycled once for every two phases of the reference frequency F. The phase counter generator 56, can be implemented directly by the micro-controller 30. An internal timer is used to generate the binary count sequence 57 directly to parallel output ports based on a crystal clock timebase (not shown).

The signal to be analyzed is input from the microphone 28 or an external input jack (not shown). This signal is amplified and buffered by a pre-amp 40. The output is connected to an ALC amplifier 42 (automatic level control amplifier), which is connected to a programmable filter 44. This filter can be implemented using switched capacitor techniques with low pass and band pass modes. The output of the programmable filter 44 is connected to a positive rectifier 46.

The output of the positive rectifier 46 is connected to a lamp driver 48, which generates a current level to drive the strobe display array 12. The drive current is active only on the positive wave form portions of the input signal and is proportional to signal magnitude. This results in an LED display which is off during negative wave form portions, and varies in intensity proportional to signal magnitude during the positive wave form portions.

The output of the positive rectifier 46 is also connected to a level controller 50, which generates a control signal for the ALC amplifier 42. This forms an automatic level control loop which causes the peak signal level at the output of the positive rectifier 46 to maintain a constant signal level, despite changes in the input signal levels.

The effect of the strobe display array 12, and its driving elements is this: The input signal conditioning creates a strobe array display 12 drive current that is zero during the negative portions of the wave form and proportional to the magnitude of the positive portions of the input signal wave form. The peak level of this conditioned signal is also automatically controlled to a constant level. The result is that the brightness of the LED that is currently enabled by the strobe display decoder 54 is proportional to the momentary wave form magnitude. At the same time, the strobe display decoder 54, is shifting the enable signal around the strobe display array 12. If the input signal pitch is the same as the reference frequency F, then for each revolution of the enable signal, exactly two positive phases of the input signal will have occurred. This will result in a stroboscopic pattern with two groups of illuminated elements on opposite sides of the strobe display array 12, which will appear to stand still. If the input signal is sharp relative to the reference frequency, the two groups will appear to rotate to the right. If it is flat, the two groups will appear to rotate to the left.

The note display array 14 is connected to a note decoder/driver 64. This is controlled by the micro-controller 30. The octave display array 16 is connected to an octave decoder/driver 66. This is controlled by the micro-controller 30. The sharp/flat indicator 18 and alpha-numeric display 20 are also controlled by the micro-controller 30. The calibration adjustment select 22, the note select input 24, and the mode select input 26, are all connected to the micro-controller 30 to allow adjustment of the tuning device and its modes.

The circuitry mentioned so far is sufficient for manual operation of the tuning instrument. The note, which is selected manually, is displayed on the note display array 14 and the octave display array 16. The input pitch is applied to the tuning instrument and the instrument being tuned is adjusted until two groups of illuminated elements appear, and the rotation of these groups is stopped.

To improve the ease of use of the tuning device, and allow hands off operation, the components to allow the micro-controller 30 to select the closest note in the chromatic scale to the input pitch, and automatically set the device accordingly, are provided. The conditioned input signal from the programmable filter 44 is connected to a fundamental period detector 52. In its simplest form, the fundamental period detector 52 is implemented as a comparator configured as a zero crossing detector. Hysteresis may be used in this comparator to improve its performance in the presence of noise on the input signal. The fundamental period detector 52 is connected to an internal timer input of the micro-controller 30. The fundamental period detector 52 produces a logic level pulse train with a period the same as the fundamental pitch of the input signal. The micro-controller 30 measures this period, and determines the closest chromatic scale note to it. It then sets the phase counter generator 56 to the closest note. It also updates the note display array 14 and the octave display array 16 accordingly. This allows the tuning device to track the input pitch signal without the need to adjust the note settings each time a different input pitch is applied. The micro-controller 30 also compares the output of the fundamental period detector 52 with the period of the reference frequency and controls the sharp/flat indicator 18 accordingly.

The phase counter generator 56 outputs the next to highest order bit of the binary count sequence 57 to a reference tone generator 58. This signal is the same as the reference frequency. The reference tone generator 58 filters out the harmonics to produce a reference tone. This signal is applied to a speaker 60 to produce an audible reference for tuning. An output jack 62 can also be used to drive an external amplifier with the reference tone generator 58 output.

Description of alternative embodiments

The above description is of an embodiment using analog techniques for the signal conditioning functions. A repartitioning of this embodiment is possible providing all of the described function, with a reduced parts count and enhanced utility. This is accomplished by using a micro-controller 30 with digital signal processing capabilities. The output of the ALC amplifier 42 is read directly by the micro-controller 30 using an analog to digital converter input. The functions of the programmable filter 44, the positive rectifier 46, the level controller 50, and the fundamental period detector 52 are then performed by the micro-controller 30 using digital signal processing techniques. The micro-controller 30 then outputs to the ALC amplifier 42 and lamp driver 48 using digital to analog converter outputs. This embodiment could provide enhanced programmable filter 44 and fundamental period detector 52 functions.

A further enhancement of the strobe display operation is possible by using bi-color luminous elements. Each element of the strobe display array 12 would be capable of emitting two separate colors. The positive rectifier 46 would control the intensity of the first color elements. A negative rectifier (not shown) would connect to the programmable filter 44 output. The negative rectifier output would control the intensity of the second color elements. The enabled element of the strobe display array 12 would be the first color during positive portions of the input wave form and the second color during negative portions of the input wave form. The resulting strobe display would contain information about the entire input wave form shape, rather than just the positive portion.

Operation of the tuning device

In manual mode the note to be tuned is selected using the note select input 24. The current note setting is indicated in a clock face format on the note display array 14, and octave display array 16. The resemblance of this display to a clock face provides an indication of the instrument setting which is quickly read with the ease of reading a clock. Signal from the instrument to be tuned is input to the tuning device through the microphone 28 or external phone jack (not shown).

The input fundamental frequency is compared with the reference frequency setting and the sharp/flat indicator 18 is updated continuously. When the input signal frequency is close to the reference frequency, a two group stroboscopic pattern will be produced on the strobe display array 12. The group rotation direction indicates error direction, and rotation speed indicates error magnitude. If the error is so great that the direction of rotation is not discernible, the sharp/flat indicator 18 is used for course tuning. Once the two group pattern rotation is visible, fine tuning is performed until the rotation is stopped.

FIG. 3 shows resulting group patterns, for several inputs, of the strobe display array 12. With the programmable filter 44 switched off, the tuning device reference frequency is selected and a sine wave of the same frequency is applied to the input. The operation of the above described circuit results in two illuminated groups, opposite each other on the strobe display array 12, as in FIG. 3*a*. The apparent intensity of each group varies across its length. It will be brighter in the center than at the edges. The bright center corresponds to the central peak of the sine wave input signal. A square wave input signal will produce two groups with a uniform intensity distribution.

As the input pitch is increased, a rotation to the right starts and speeds up until imperceptible. As the pitch is increased to near the reference frequency multiplied by 1.5, a three group pattern appears on the strobe display array 12 as in FIG. 3*b*. As the input pitch is increased to twice the reference frequency, a four group pattern appears on the strobe display array 12 as in FIG. 3*c*. This repeats accordingly at harmonics of the reference frequency. When the input pitch is decreased to half the reference frequency, a single group appears on the strobe display array 12, as in FIG. 3*d*. Only when a two group pattern is visible, is the input pitch close to the reference frequency.

The programmable filter 44 is used to improve the readability of the strobe display array 12. In filter off mode, the filter passes the entire audio range through to the strobe display array 12. In tracking low pass mode, higher harmonics are filtered out. In tracking band pass mode, the band pass can be shifted to allow measurement of individual harmonics separately.

Most instruments produce harmonics. The display of these harmonics is superimposed in the strobe display array 12, resulting in a difficult to interpret display. In stringed instruments, this effect is greatest when the string is first struck. When the programmable filter 44 is configured in tracking low pass mode, harmonics are filtered out, leaving a solid two group strobe display. The programmable filter 44 low pass corner frequency is adjusted by the microcontroller 30 to track the reference frequency.

Another characteristic of stringed instruments is that the partials produced by the strings can vary from the perfect harmonic relationship. This effect is the rational for stretching of the upper octaves in piano tuning practice. By configuring the programmable filter 44 as a band pass filter with a center band pass frequency equal to the reference frequency, the selected frequency is displayed clearly even in the presence of lower frequencies. When the band pass filter is shifted above the reference frequency, the individual harmonics of a ringing string can be characterized for deviation from ideal.

In automatic mode of the tuning device, the input pitch fundamental is measured, and the tuning device set to the note closest to it. In this mode, the note display array 14 and octave display array 16 track the input note. Automatic mode is useful for tuning instruments with multiple strings, without having to adjust the note setting for each string. It is also useful in intonation training. The student plays a scale into the tuning device and both the note and error are displayed. Using the tuning device aids in the ear training necessary to play perfectly intoned scales. In addition, information about tone quality is also presented. Poor tone generates a fuzzy display, while good tone generates a crisp display.

The output of the reference tone generator 58 is connected to the speaker 60, or the output jack 62, to provide an audible tuning reference. This feature can also be used to provide a test signal to an amplifier system. The tuning device can then be placed at an equal distance from two sets of speakers and the relative phase of each measured separately. This can be used to verify correct phase connections of the amplifier/speaker systems. The phase response of a room at given test frequencies can also be characterized using the tuning device.

The tuning device described above provides the user with an easy to use and interpret display. The clock face format note/octave display is readily interpreted. The strobe display and its associated signal conditioning provides a high accuracy, fine tuning display with instantaneous response time. Signal conditioning options are provided to optimize filtering functions for various operations and input signals. Control functions provided a sharp/flat indication for gross tuning. Control functions also provided for automatic mode operation, where the tuning device note setting automatically tracks the input pitch.

I claim:

1. A tuning aid for musical instruments comprising:

(a) a note/octave display comprising indication elements arranged in a pattern around two concentric circles to resemble a clock face having an inside pattern corresponding to an hour hand designating an octave and an outside pattern corresponding to a minute hand designating the twelve notes of a chromatic scale;

(b) a strobe display array consisting of a plurality of luminous elements arranged in a circular pattern;

(c) a reference frequency generating means of generating a reference frequency;

(d) a control means of controlling the reference frequency to a desired note to be tuned and controlling the note/octave display accordingly;

(e) a means of enabling each element of said strobe display sequentially at a rate such that said strobe display cycles once for each two periods of said reference frequency, each enabled element having an intensity;

(f) a means of inputting a signal having a peak level for analysis;

(g) a level control means of automatically controlling the peak level of said signal to a predetermined level and producing a level controlled output;

(h) a filtering means of receiving the level controlled output and producing a filtered output;

(i) a positive rectifying means of positive rectification of the filtered output of said filtering means and producing a positive rectified output having an instantaneous magnitude;

(j) a means of controlling the intensity of the enabled element of said strobe display according to the instantaneous magnitude of the positive rectified output of said positive rectifying means.

2. A tuning aid as in claim 1 wherein said filtering means is configured in low pass mode and is adjusted by said control means to attenuate signal harmonics higher than said reference frequency.

3. A tuning aid as in claim 1 wherein said filtering means is configured in band pass mode and is controlled by said control means to pass only a selected signal harmonic.

4. A tuning aid as in claim 1 in which the filtering means is connected to a fundamental period detection means which is connected to said control means controlling a sharp/flat indication means accordingly.

5. A tuning aid as in claim 1 in which the filtering means is connected to a fundamental period detection means which determines the input signal's fundamental frequency and is connected to said control means which automatically selects the note from the chromatic scale closest to the input signal fundamental frequency and sets said reference frequency and said note/octave display accordingly.

6. A tuning aid as in claim 1 including a reference tone generation means connected to a speaker and an output jack wherein an audible reference tone is provided.

7. A tuning aid for musical instruments comprising:

(a) a strobe display array consisting of a plurality of luminous elements arranged in a circular pattern;

(b) a reference frequency generating means of generating a reference frequency;

(c) a control means of controlling the reference frequency to a desired note to be tuned;

(d) a means of enabling each element of said strobe display sequentially at a rate such that said strobe display cycles once for each two periods of said reference frequency; each enabled element having an intensity;

(e) a means of inputting a signal having a peak level for analysis;

(f) a means of automatically controlling the peak level of said signal to a predetermined level and producing a level controlled output;

(g) a filtering means of filtering said level controlled output configured in tracking low pass mode which is controlled by said control means to attenuate signal harmonics higher than said reference frequency and producing a filtered output;

(h) a positive rectifying means of positive rectification of the filtered output of said filtering means and producing a positive rectified output having an instantaneous magnitude;

(i) a means of controlling the intensity of the enabled element of said strobe display according to the instantaneous magnitude of the positive rectified output of said positive rectifying means.

8. A tuning aid as in claim 7 comprising in addition a negative rectification means attached to said filtering means wherein said luminous elements can emit two separate colors of light wherein the intensity of the first color is controlled by said positive rectifier means and the intensity of the second color is controlled by said negative rectifier means.

9. A tuning aid as in claim 7 wherein said filtering means is configured in band pass mode and is controlled by said control means to pass only a selected signal harmonic.

10. A tuning aid as in claim 7 in which said input means is connected to a fundamental period detection means which is connected to said control means controlling a sharp/flat indication means accordingly.

11. A tuning aid as in claim 7 in which said input means is connected to a fundamental period detection means which determines the input signal's fundamental frequency and is connected to said control means to automatically select the note from the chromatic scale closest to the input signal fundamental frequency and set said reference frequency and a note/octave indicator means accordingly.

12. A tuning aid for musical instruments comprising:

(a) a note/octave display comprising indication elements arranged in a pattern around two concentric circles to resemble a clock face having an inside pattern corresponding to an hour hand designating an octave and an outside pattern corresponding to a minute hand designating the twelve notes of a chromatic scale;

(b) a signal input means of inputting a signal for analysis;

(c) a fundamental period detector means connected to said signal input means, for determining the fundamental period of the input signal;

(d) a control means connected to said fundamental period detector means which identifies the note from a chromatic scale closest to said fundamental period and controls the note/octave display accordingly.

13. A tuning aid as in claim 12 comprising in addition a sharp/flat indicator means wherein said control means determines the difference between the fundamental period and the note closest to it in a chromatic scale and controls said sharp/flat indication means accordingly.

* * * * *